US007841930B2

(12) United States Patent
Rimmer et al.

(10) Patent No.: US 7,841,930 B2
(45) Date of Patent: Nov. 30, 2010

(54) ADJUSTABLE TERMINAL BASKET WITH LIGHT WEIGHT, HORIZONTAL DIFFUSER GRILLE

(75) Inventors: Julian Douglas Rimmer, Winnipeg (CA); David Surminski, Winnipeg (CA); David Dyck, Winnipeg (CA); Jeremy Sparling, Winnipeg (CA); Christopher Schwill, Winnipeg (CA)

(73) Assignee: Price Companies, Inc. (CA)

( * ) Notice: Subject to any disclaimer, the term of this patent is extended or adjusted under 35 U.S.C. 154(b) by 399 days.

(21) Appl. No.: 11/845,168

(22) Filed: Aug. 27, 2007

(65) Prior Publication Data

US 2009/0061757 A1 Mar. 5, 2009

Related U.S. Application Data

(60) Provisional application No. 60/943,969, filed on Jun. 14, 2007.

(51) Int. Cl.
*F24F 13/08* (2006.01)

(52) U.S. Cl. ..... 454/290

(58) Field of Classification Search ..... 454/290
See application file for complete search history.

(56) References Cited

U.S. PATENT DOCUMENTS 323,300 A * 7/1885 Durneck ..... 454/270
2006/0246835 A1 * 11/2006 Rimmer et al. ..... 454/290

* cited by examiner

*Primary Examiner*—Steven B McAllister
*Assistant Examiner*—Samantha A Miller
(74) *Attorney, Agent, or Firm*—Smith, Gambrell & Russell

(57) ABSTRACT

An adjustable terminal basket with lightweight horizontal diffuser grille is mounted in the floor of an occupied space for delivering conditioned air from an under floor air plenum to the occupied space above the floor. The modular floor terminal basket regulates the air passing through the terminal, and the lightweight horizontal diffuser grille diffuses the conditioned air along the floor of the occupied space. The lightweight horizontal diffuser grille is constructed with a top and bottom plate with hollow support pillars between the plates and with reinforcing ribs adjacent the center of the diffuser grille.

8 Claims, 8 Drawing Sheets

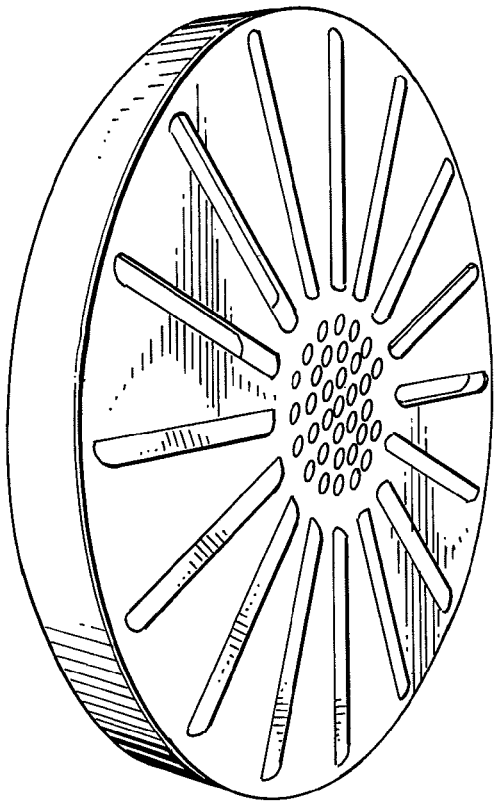
PRIOR ART
Fig. 3
Fig. 4
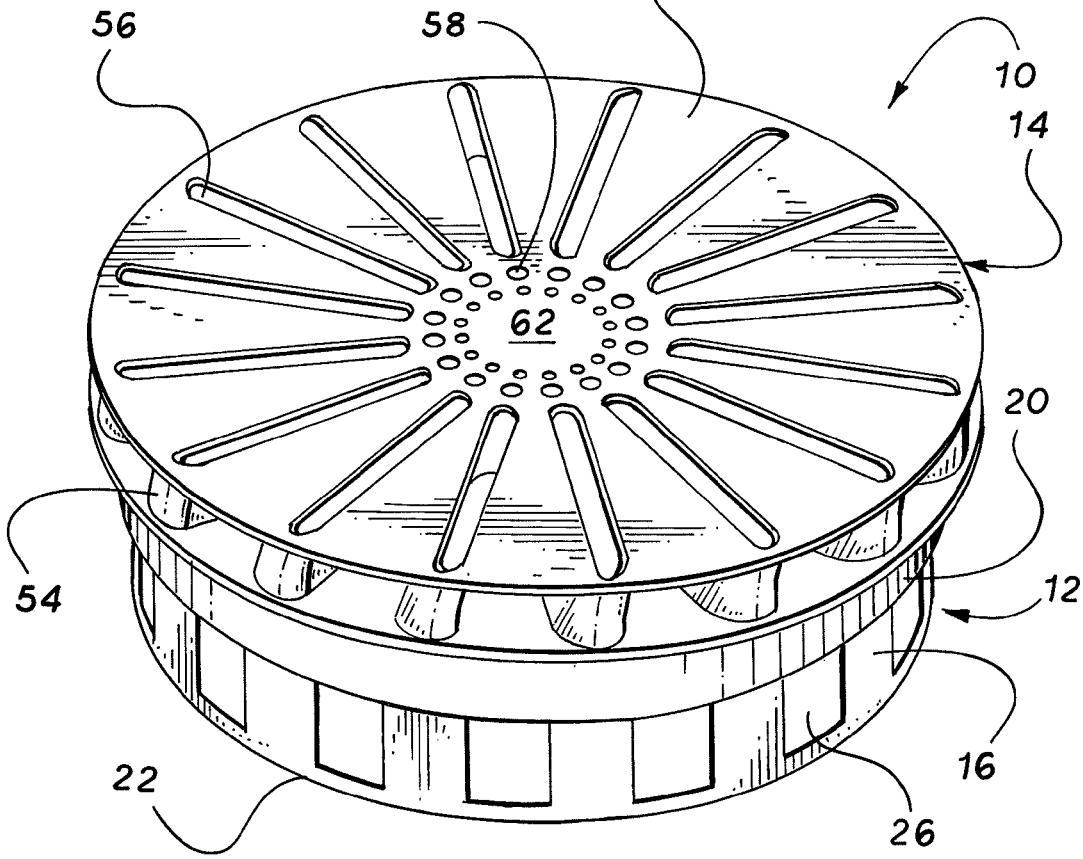

ADJUSTABLE TERMINAL BASKET WITH LIGHT WEIGHT, HORIZONTAL DIFFUSER GRILLE

CROSS-REFERENCE TO RELATED APPLICATION

This application claims the benefit of prior U.S. Provisional Application Ser. No. 60/943,969, filed Jun. 14, 2007.

FIELD OF THE INVENTION

This invention relates to a modular floor terminal having an adjustable basket with a light weight horizontal diffuser grille for use with an HVAC system with an under floor air plenum.

BACKGROUND OF THE INVENTION

In an HVAC system having an under floor air plenum, cool or warm air is supplied to the plenum below the floor of an occupied space to be cooled or heated. In order to cool or heat the occupied space above the floor, modular terminals with diffuser grilles are mounted in the floor at predetermined locations to allow the cool or warm air in the plenum to flow into the occupied space above the floor. The terminals are located and oriented to accommodate the configuration of the occupied space to be cooled or heated.

Typically the floor terminal includes a basket mounted in the floor of an occupied space for delivering air from the under floor air plenum to the occupied space above the floor through a diffuser grille. In some installations, the modular floor terminal basket includes a stationary round basket and rotatable internal round basket. Both the stationary basket and the rotatable basket have openings in their sides and bottoms. Rotation of the internal basket within the stationary basket opens and closes the openings thereby controlling the amount of air that flows through the terminal basket, through the diffuser grille, and into the occupied space. The internal rotatable basket is connected to the diffuser grille so that rotation of the diffuser grille opens and closes the openings and thereby controls the amount of air flowing through the floor terminal. Walker U.S. Pat. No. 6,361,432 discloses a modular floor terminal with a stationary basket and a rotatable basket connected to the diffuser grille.

In certain cooling applications, it is advantageous to have a diffuser grille that diffuses the cooled air in a low velocity horizontal swirl pattern that remains tight to the floor as the cooling air from the under floor plenum displaces the air in the occupied space. The low velocity cooling air mixes slowly with the air in the occupied space rising slowly as the heat load from people and equipment is absorbed. H. Krantz-TKT GmbH has manufactured and sold at a metal horizontal diffuser grille shown in FIGS. 1-3. While the Krantz diffuser grille has enjoyed success in the marketplace, the weight and cost of the Krantz horizontal diffuser grille has limited its acceptance and competitiveness in the marketplace.

SUMMARY OF THE INVENTION

Therefore, it is an object of the present invention to provide a modular floor terminal having an adjustable terminal basket with a lightweight plastic horizontal diffuser grille. The modular floor terminal has a stationary basket fixed to the floor and a rotatable basket nested inside of the stationary basket. The relative rotation between the stationary basket and rotatable basket opens and closes the openings in the baskets, which in turn controls the air flow from the under floor air plenum, through the lightweight horizontal diffuser grille, to the occupied space above the floor. Moreover, the lightweight horizontal diffuser grille of the present invention is connected to the rotatable basket so that that rotation of the lightweight horizontal diffuser grille controls the amount of air flowing through the modular terminal to the occupied space.

The lightweight horizontal diffuser grille has an I-beam like structure with a top plate and a bottom plate spaced apart by means of a series of radially extending hollow pillars. Each of the pillars has a radially extending slot that extends through the pillar from the top plate to the bottom plate. The pillar configuration of the lightweight horizontal diffuser grille lends itself to a single step molding process. The radially extending slots are oriented at an angle from an axis oriented perpendicular to the top plate and the bottom plate. As conditioned air passes through the radially extending slots in each of the pillars, the angle of the slots from the perpendicular imparts a swirling motion to the conditioned air, which in turn, spreads the conditioned air horizontally along the floor of the occupied space. The diffuser grille also has a series of holes in the top plate near the center of the lightweight horizontal diffuser grille. The holes exhaust the conditioned air vertically at low velocity in order to inhibit the mixing of the room air with the conditioned air spreading horizontally from the radial slots of the diffuser grille. In order to ensure adequate structural support for the diffuser grille at its center, a series of support ribs is formed below the holes to support the top plate.

Further objects, features and advantages will become apparent upon consideration of the following detailed description of the invention when taken in conjunction with the drawing and the appended claims.

BRIEF DESCRIPTION OF THE DRAWINGS

FIG. 3 is a perspective view of the prior art Krantz metal horizontal diffuser grille.

FIG. 4 is a top perspective view of the modular floor terminal having an adjustable terminal basket and a lightweight horizontal diffuser grille in accordance with the present invention.

DETAILED DESCRIPTION OF THE PREFERRED EMBODIMENT

Figure 1:
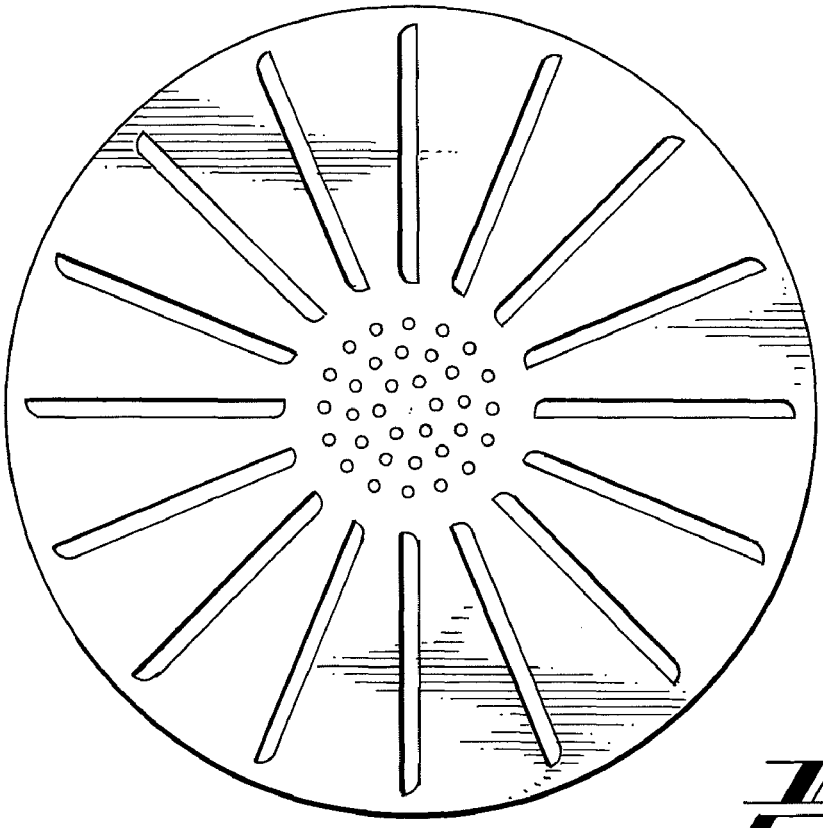
PRIOR ART Fig. 1
FIG. 1 is a top plan view of a prior art Krantz metal horizontal diffuser grille.
Figure 2:
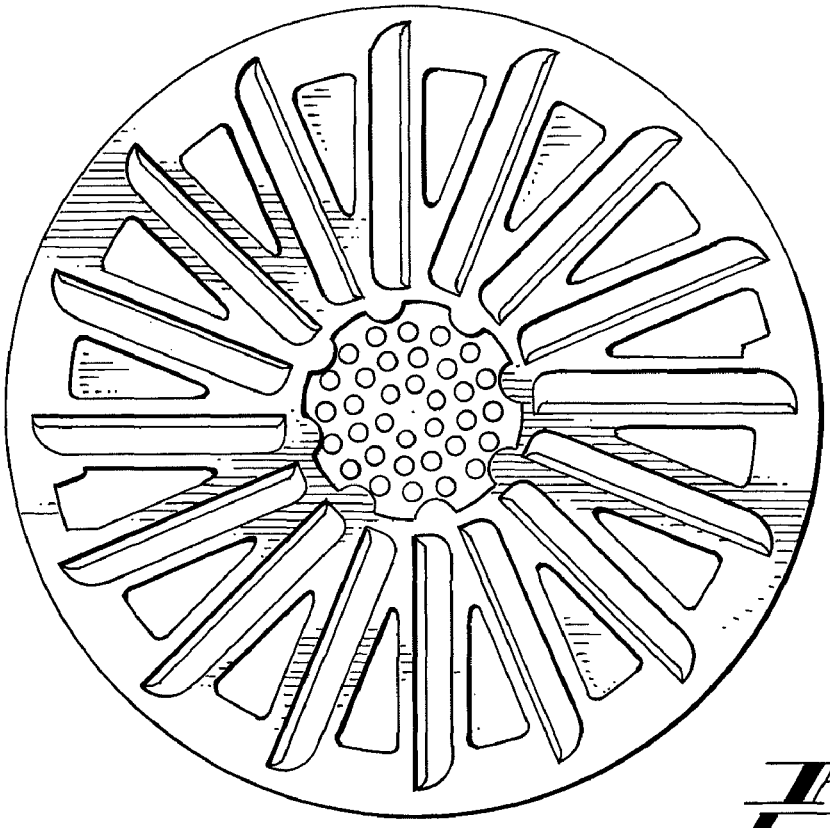
PRIOR ART Fig. 2
FIG. 2 is a bottom plan view of the prior art Krantz metal horizontal diffuser grille.
Figure 5:
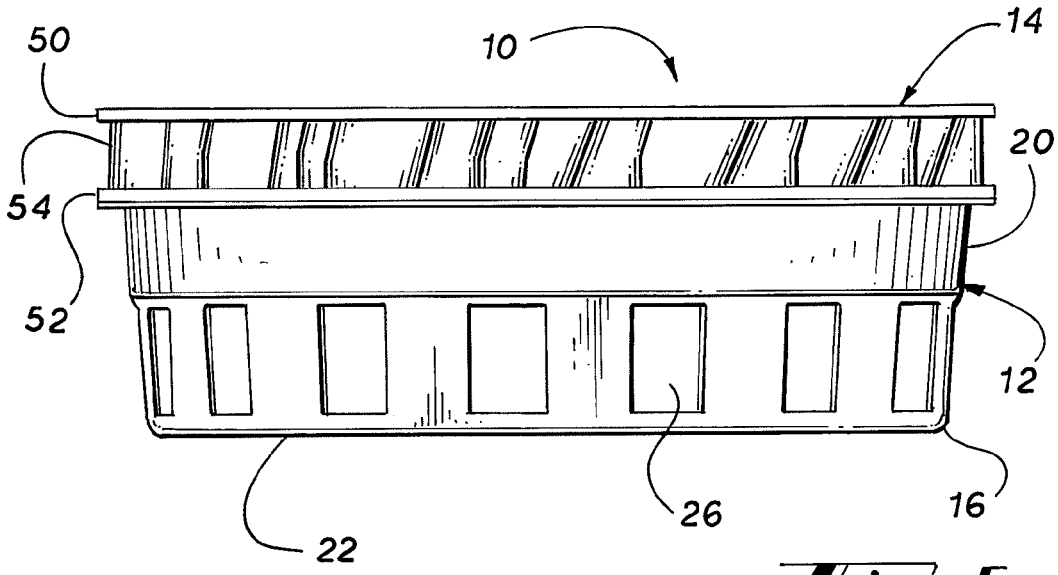
FIG. 5 is a side elevation view of the modular floor terminal having an adjustable terminal basket and a lightweight horizontal diffuser grille in accordance with the present invention.
Figure 6:
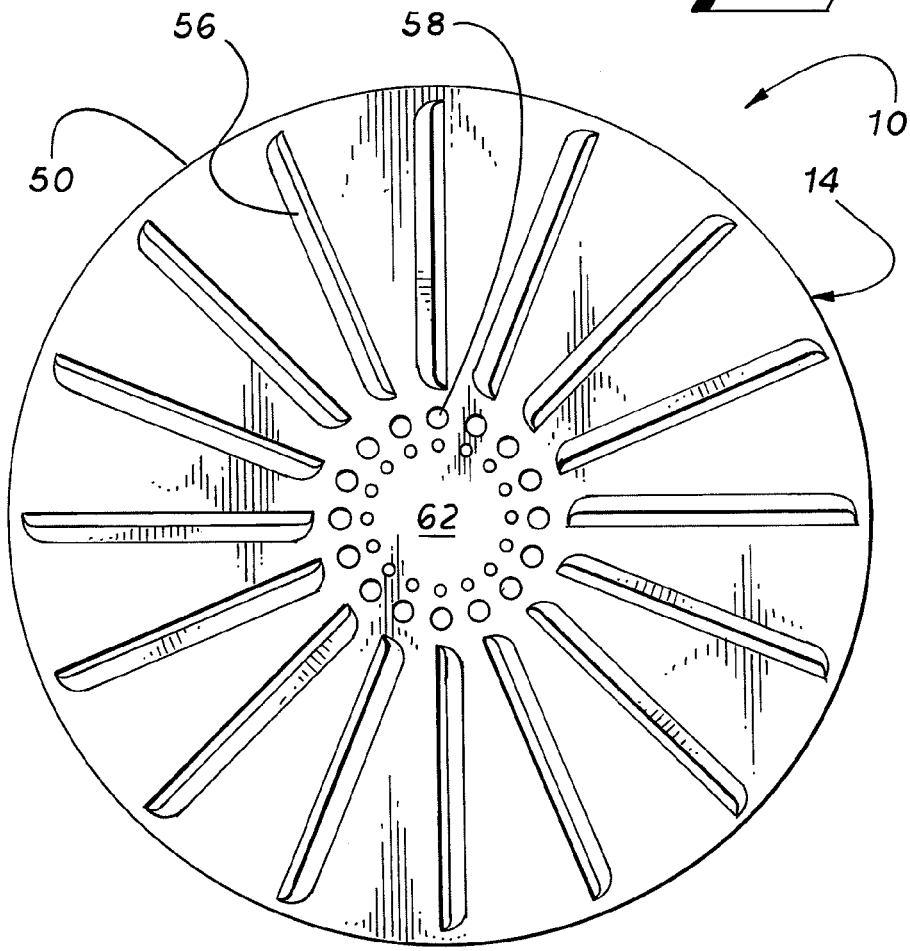
FIG. 6 is a top plan view of the modular floor terminal having an adjustable terminal basket and a lightweight horizontal diffuser grille in accordance with the present invention.
Figure 7:
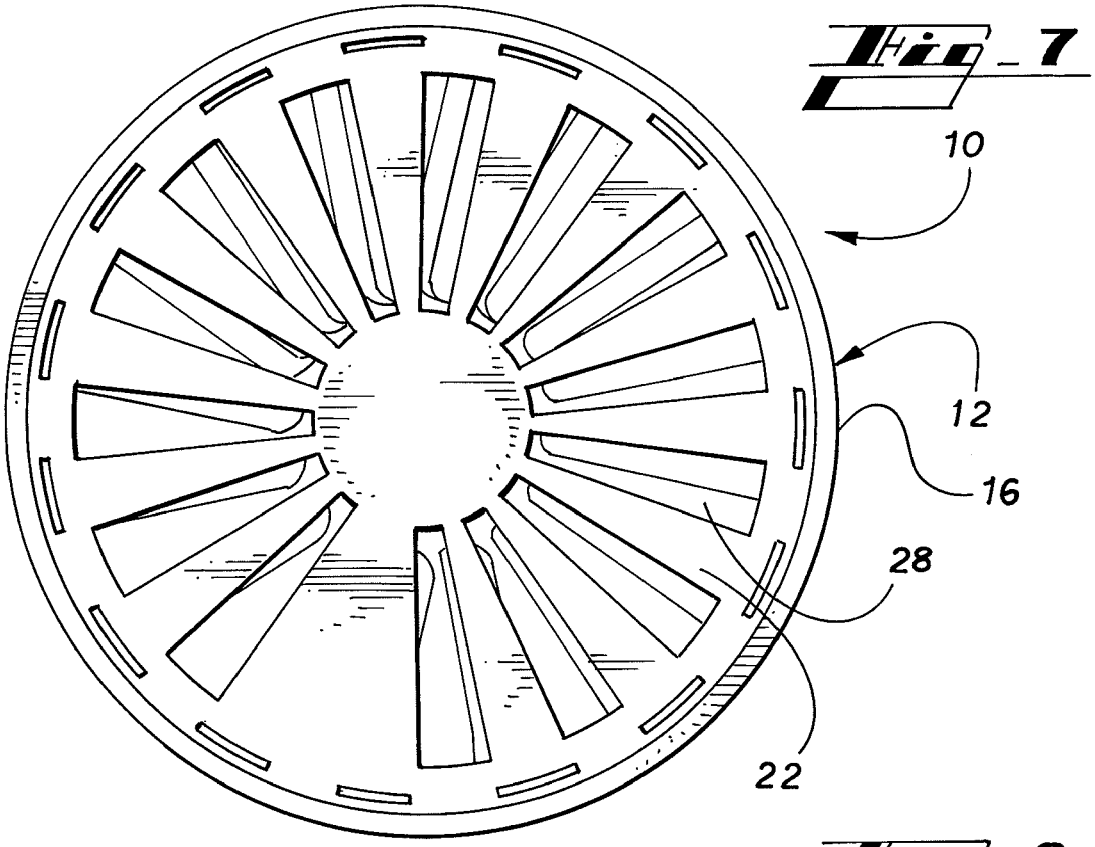
FIG. 7 is a bottom plan view of the modular floor terminal having an adjustable terminal basket and a lightweight horizontal diffuser grille in accordance with the present invention.

FIGS. 4-9 illustrate a modular floor terminal 10 having an adjustable terminal basket 12 with a lightweight horizontal diffuser grille 14 in accordance with the present invention. The basket 12 is generally cylindrical and comprises an exterior stationary basket 16 and an internal rotatable basket 18 nested within the exterior stationary basket 16. The stationary basket 16 is mounted in an opening in the floor of an occupied space and is in communication with an underlying air plenum. The stationary basket 16 has a circumference 20, a bottom 22, and a top opening 24. The stationary basket 16 has a series of openings 26 around its circumference 20 and another series of openings 28 in its bottom 22. The rotatable basket 18 similarly has a circumference 30, a bottom 32, and a top opening 34. The rotatable basket 18 has a series of openings 36 around its circumference 30 and another series of openings 38 in its bottom 32.

The rotatable basket 18 is nested within the stationary basket 16 for relative rotation. Rotating the rotatable basket 18 within the stationary basket 16 opens and closes the circumferential openings 26 and 28 and the bottom openings 36 and 38. A setpoint mechanism 40 consists of an adjustable post 42 on the stationary basket 16 that engages the edge of an enlarged setpoint opening 44 in the bottom 32 of the rotatable basket 18. The setpoint mechanism 40 sets the minimum degree of opening when the modular floor terminal is set at its minimum flow rate.

Figure 9:
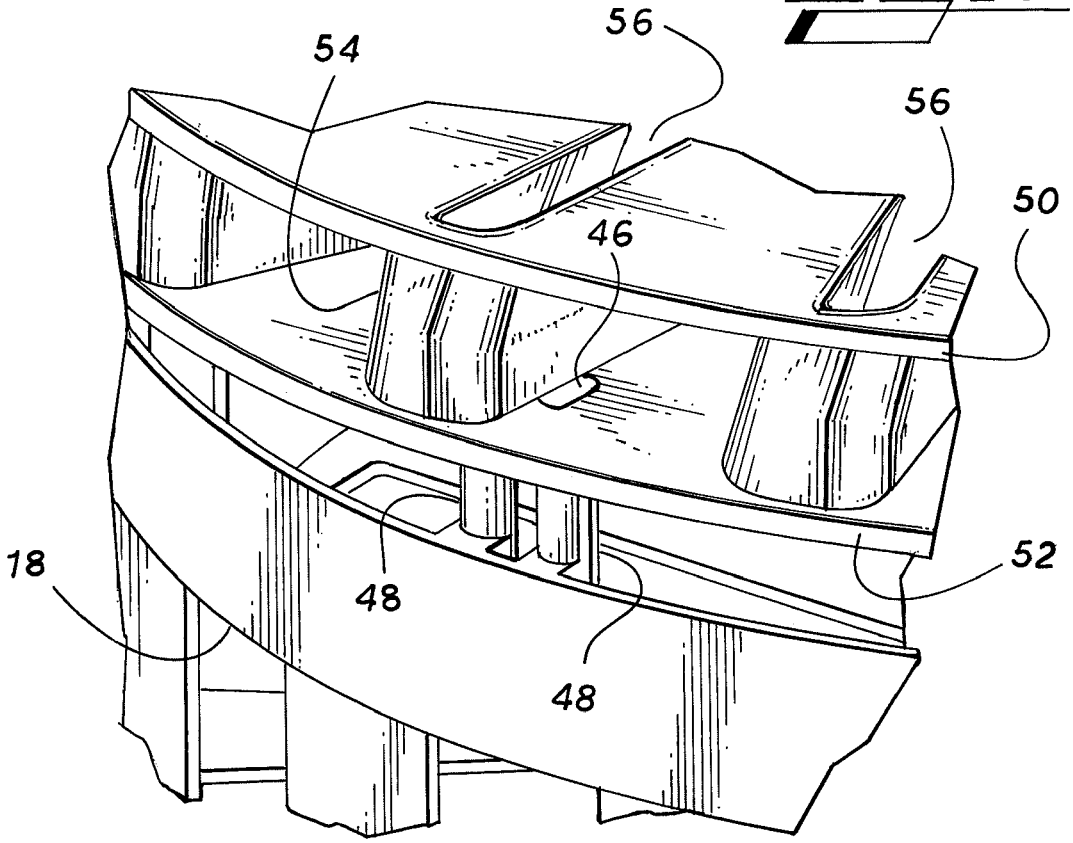
FIG. 9 is a detailed top perspective view of the engagement pins and slots connecting the lightweight horizontal diffuser grille to the rotatable basket of the modular floor terminal in accordance with the present invention.
Figure 8:
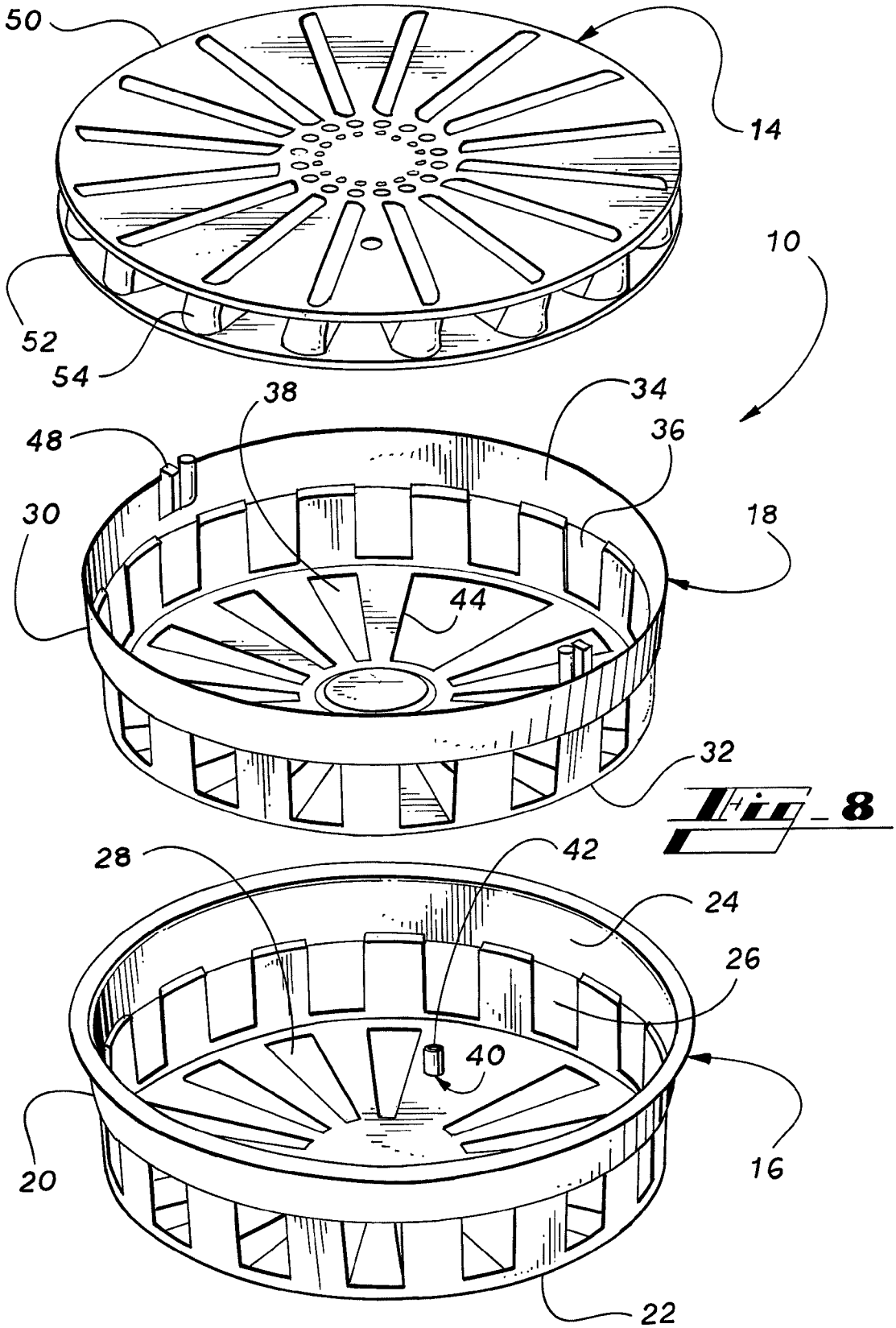
FIG. 8 is an exploded perspective view of the modular floor terminal having an adjustable terminal basket and a lightweight horizontal diffuser grille in accordance with the present invention.
Figure 10:
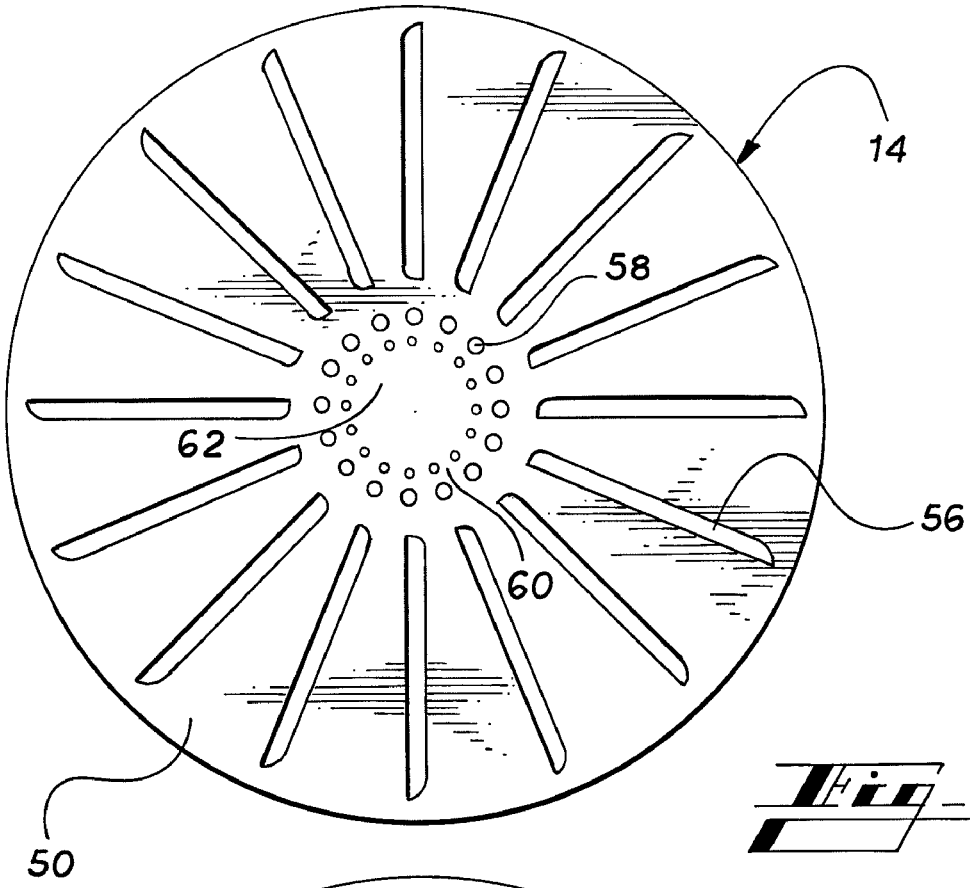
FIG. 10 is a top plan view of the lightweight horizontal diffuser grille in accordance with the present invention.
Figure 11:
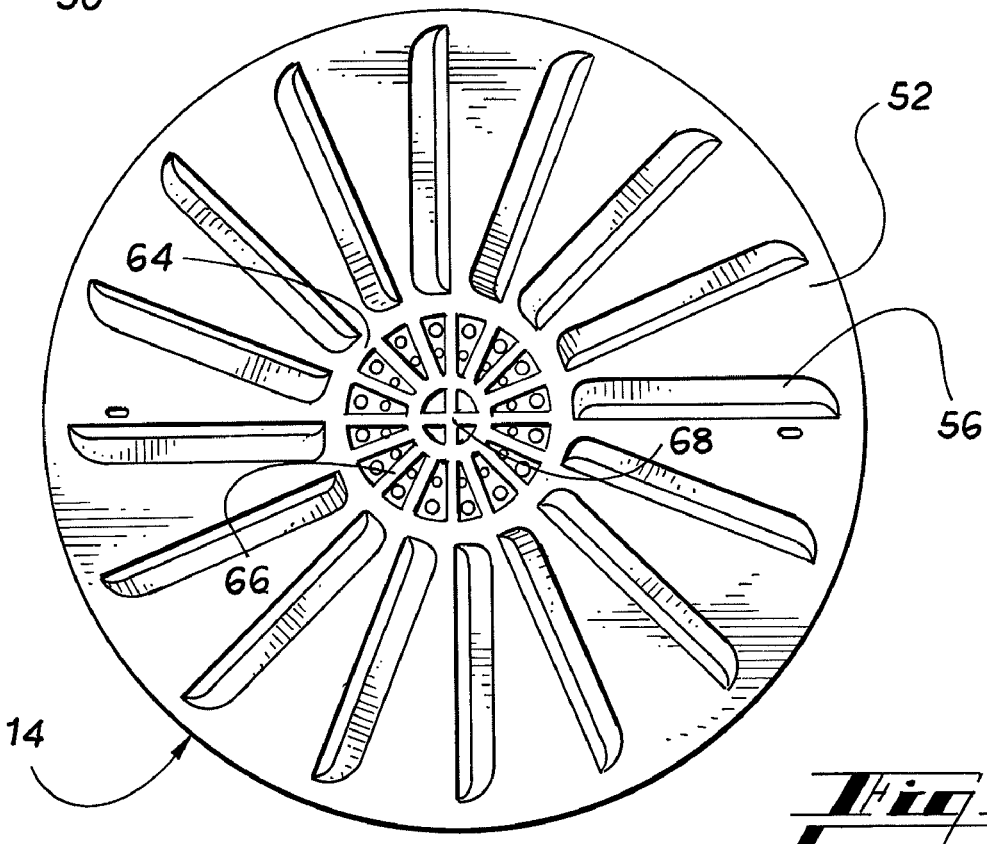
FIG. 11 is a bottom plan view of the lightweight horizontal diffuser grille in accordance with the present invention.
Figure 12:
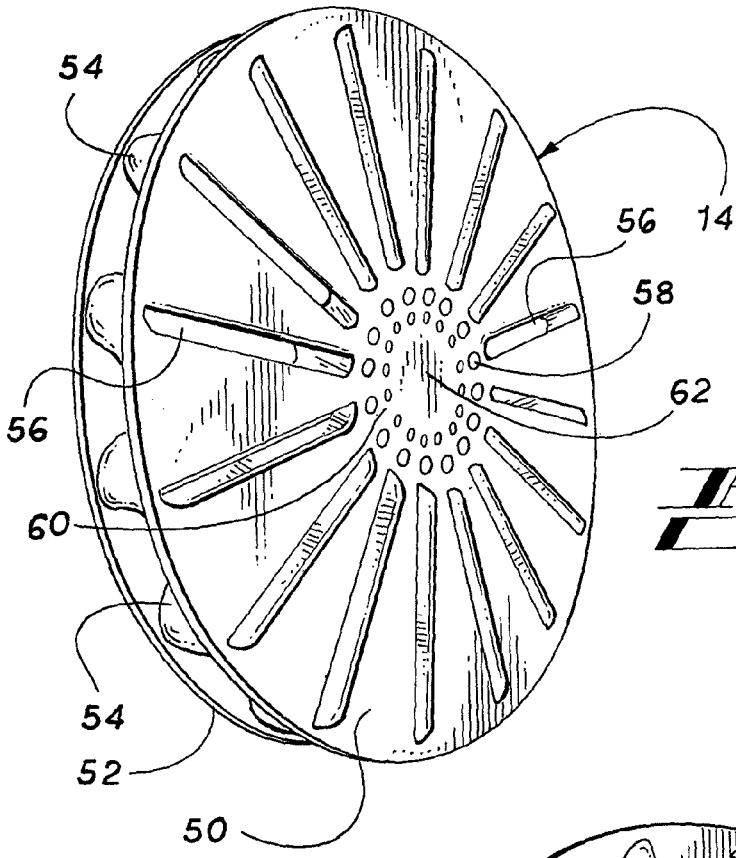
FIG. 12 is a top perspective view of the lightweight horizontal diffuser grille in accordance with the present invention.
Figure 13:
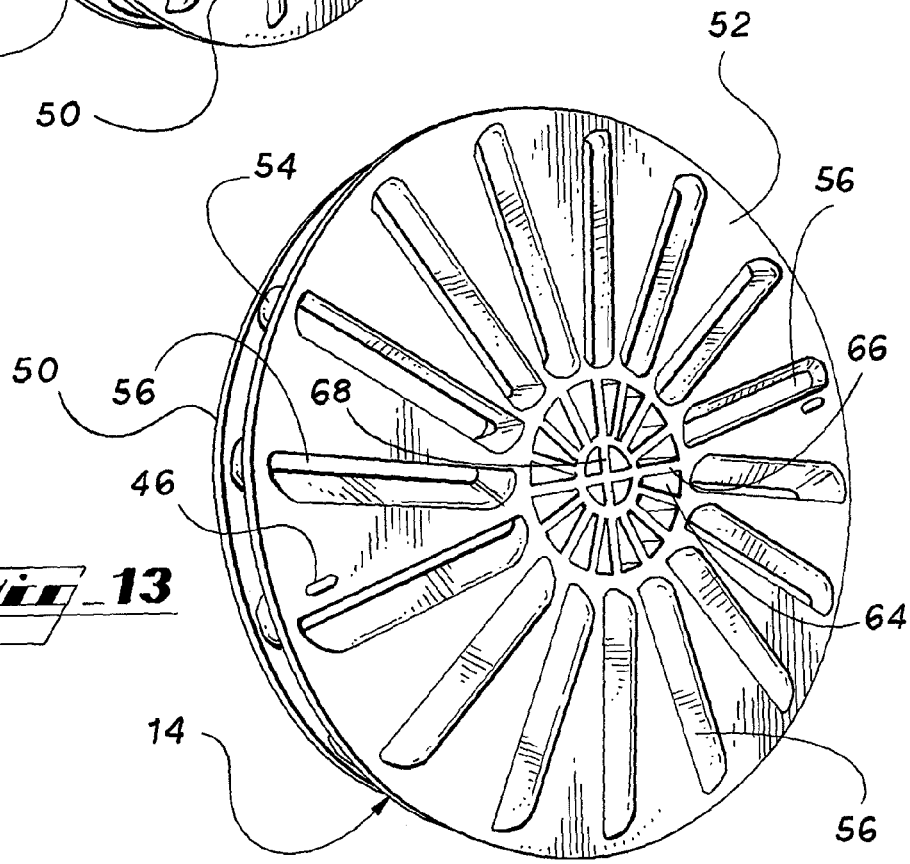
FIG. 13 is a bottom perspective view of the lightweight horizontal diffuser grille in accordance with the present invention.
Figure 14:
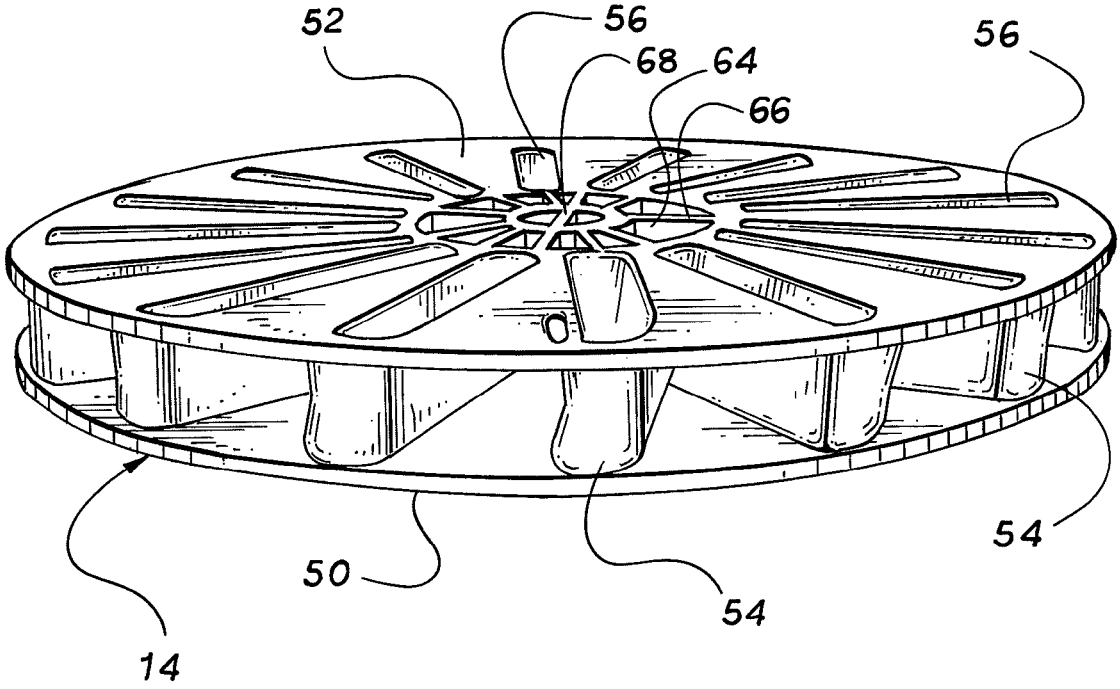
FIG. 14 is a side perspective view of the lightweight horizontal diffuser grille in accordance with the present invention.

The lightweight horizontal diffuser grille 14 is mounted on top of the rotatable basket 18 so that control slots 46 in the lightweight horizontal diffuser grille 14 engage pins 48 on the top of the internal rotatable basket 18 (FIGS. 8 and 9). The lightweight horizontal diffuser grille 14 is constructed of an engineered polymer sold by General Electric Company under the designation LNP Starflam Compound PZ0062E. Also known as: LNP* Starflam* Compound PF-1006 Z222. LNP STARFLAM* PZ0062E is a compound based on Nylon 6 resin containing Glass Fiber, Flame Retardant.

TABLE 1

TYPICAL PROPERTIES

| | Value | Unit | Standard |
|---|---|---|---|
| MECHANICAL | | | |
| Tensile Stress, break | 120 | MPa | ISO 527 |
| Tensile Strain, break | 2-3 | % | ISO 527 |
| Tensile Modulus, 1 mm/min | 8100 | MPa | ISO 527 |
| Flexural Stress | 160 | MPa | ISO 178 |
| Flexural Modulus | 7300 | MPa | ISO 178 |
| IMPACT Value Unit Standard | | | |
| Izod Impact, unnotched 80 * 10 * 4 + 23° C. | 35 | $kJ/m^2$ | ISO 180/1U |
| Izod Impact, notched 80 * 10 * 4 + 23° C. | 8 | $kJ/m^2$ | ISO 180/1A |
| THERMAL | | | |
| HDT/Af, 1.8 MPa Flatw 80 * 10 * 4 sp = 64 mm | 195 | ° C. | ISO 75/Af |

TABLE 1-continued

TYPICAL PROPERTIES

| | Value | Unit | Standard |
|---|---|---|---|
| PHYSICAL | | | |
| Mold Shrinkage, flow, 24 hrs | 0.2-0.5 | % | ISO 294 |
| Density | 1.42 | $g/cm^3$ | ISO 1183 |
| FLAME CHARACTERISTICS | | | |
| UL Compliant, 94V-2 Flame Class Rating (3)(4) | 1.6 | mm | UL 94 by GE |

PROCESSING

| Parameter<br>Injection Molding | Value | Unit |
|---|---|---|
| Drying Temperature | 80 | ° C. |
| Drying Time | 4 | hrs |
| Maximum Moisture Content | 0.15-0.25 | % |
| Melt Temperature | 255-265 | ° C. |
| Front - Zone 3 Temperature | 250-260 | ° C. |
| Middle - Zone 2 Temperature | 250-260 | ° C. |
| Rear - Zone 1 Temperature | 245-255 | ° C. |

The lightweight horizontal diffuser grille 14 (FIGS. 10-14) comprises a top plate 50 and a bottom plate 52. The top plate 50 and the bottom plate 52 are spaced apart by means of a series of radially extending hollow pillars 54. Each of the pillars 54 has a slot 56 that extends through the pillar 54 from the top plate 50 to the bottom plate 52 and that extends along the radial length of the pillar 54. The radially extending slots 56 in each of the pillars 54 allow for the passage of conditioned air from the terminal basket 12 through the lightweight horizontal diffuser grille 14 to the occupied space. The radially extending slots 56 are also oriented at an angle from an axis oriented perpendicular to the top plate 50 and the bottom plate 52. The angle of the slots 56 from the perpendicular imparts a swirling motion to the conditioned air as the conditioned air passes through the slots 56.

The diffuser grille 14 also has a series of holes 58 in the top plate 50 near the center 62 of the lightweight horizontal diffuser grille 14. The holes 58 are oriented in concentric rings 60 around the center 62 of the lightweight horizontal diffuser grille 14. The holes 58 exhaust conditioned air vertically at low velocity through the lightweight horizontal diffuser grille 14 into the occupied space. The low velocity conditioned air exiting the diffuser grille 14 through holes 58 inhibits the mixing of the room air with the conditioned air spreading horizontally from the radial slots 56.

The pillars 54, the top plate 50, and the bottom plate 52 create an I-beam like structure providing rigidity to the diffuser grille 14. In addition, the separate pillars 54 allow for injection molding of the diffuser grille 14 in a single operation. In order to ensure adequate structural support for the diffuser grille 14 at its center 62, a series of support ribs 64 is formed below the holes 58 to support the top plate 50. The support ribs 64 include radially extending ribs 66 and cross ribs 68. Such ribs 64 provide the needed support for the center of the lightweight, plastic embodiment of the diffuser grille 14 of the present invention.

While this invention has been described with reference to preferred embodiments thereof, it is to be understood that variations and modifications can be affected within the spirit and scope of the invention as described herein and as described in the appended claims.

We claim:

1. A modular floor terminal that controls flow of conditioned air from an air plenum below a floor to an occupied space above the floor comprising:

a. an adjustable terminal basket supported by the floor and extending into the air plenum below the floor and having:

i. an outer basket portion, an inner basket portion rotatable relative to the outer basket portion and the outer basket portion having an inlet and outer peripheral wall respectively, wherein the rotation of the inner basket portion relative to the outer basket portion provides an adjustable air inlet;

b. a horizontal diffuser grille mounted on the top of the basket over the air outlet comprising:

i. a top plate having a center;

ii. a bottom plate spaced apart from the top plate;

iii. a series of pillars between the top plate and the bottom plate for supporting the top plate and bottom plate in a spaced apart relationship; and iv. angled slots extending between the top plate and the bottom plate through the hollow pillars.

2. The modular floor terminal of claim 1, wherein the horizontal diffuser grille further includes a series of holes in the top plate adjacent the center of the top plate.

3. The modular floor terminal of claim 2, wherein the horizontal diffuser grille further includes series of radially extending ribs beneath the holes adjacent the center of the top plate.

4. The modular floor terminal of claim 1, wherein the top plate and the bottom plate are circular, and the pillars are oriented radially.

5. The modular floor terminal of claim 1, wherein the slots are angled from an axis perpendicular to the top plate and the bottom plate.

6. A horizontal diffuser grille comprising:

a. a top plate having a solid center region and having a plurality of holes located adjacent the center region;

b. a bottom plate spaced apart from the top plate, the bottom plate having a central region allowing air flow therethrough;

c. a series of radially extending hollow pillars between the top plate and the bottom plate for supporting the top plate and bottom plate in a spaced apart relationship; and d. angled slots extending between the top plate and the bottom plate through the hollow pillars.

7. The horizontal diffuser grille of claim 6, wherein the horizontal diffuser grille further includes series of radially extending ribs beneath the holes adjacent the center of the top plate.

8. The horizontal diffuser grille of claim 6, wherein the slots are angled from an axis perpendicular to the top plate and the bottom plate.

* * * * *